US008655222B2

(12) United States Patent
Nakamura et al.

(10) Patent No.: US 8,655,222 B2
(45) Date of Patent: Feb. 18, 2014

(54) DEVELOPING MEMBER, PROCESS CARTRIDGE, AND ELECTROPHOTOGRAPHIC IMAGE FORMING APPARATUS

(71) Applicant: Canon Kabushiki Kaisha, Tokyo (JP)

(72) Inventors: Minoru Nakamura, Mishima (JP); Shohei Urushihara, Suntou-gun (JP); Takashi Koyanagi, Mishima (JP); Kunimasa Kawamura, Mishima (JP); Masaki Yamada, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/920,007

(22) Filed: Jun. 17, 2013

(65) Prior Publication Data

US 2013/0279937 A1 Oct. 24, 2013

Related U.S. Application Data

(63) Continuation of application No. PCT/JP2012/006632, filed on Oct. 17, 2012.

(30) Foreign Application Priority Data

Feb. 17, 2012 (JP) ..... 2012-033078
Oct. 12, 2012 (JP) ..... 2012-227219

(51) Int. Cl.
*G03G 15/08* (2006.01)

(52) U.S. Cl.
USPC ..... 399/111; 399/286

(58) Field of Classification Search
USPC ..... 399/111, 286
See application file for complete search history.

(56) References Cited

U.S. PATENT DOCUMENTS 6,444,323 B1 9/2002 Matsumoto et al.
2005/0272893 A1 * 12/2005 Tanaka et al. ..... 528/15

FOREIGN PATENT DOCUMENTS

JP 2000-284585 A 10/2000
JP 2001-158856 A 6/2001
JP 2008-20531 A 1/2008
JP 2008-74913 A 4/2008
JP 2008-126440 A 6/2008

OTHER PUBLICATIONS

PCT International Search Report and Written Opinion of the International Searching Authority, International Application No. JP2012/006632, Mailing Date Jan. 8, 2013.

* cited by examiner

*Primary Examiner* — Walter L Lindsay, Jr.
*Assistant Examiner* — David Bolduc
(74) *Attorney, Agent, or Firm* — Fitzpatrick, Cella, Harper and Scinto

(57) ABSTRACT

Provided is a developing member capable of suppressing a variation in resistance even when exposed to a high-temperature, high-humidity environment for a long time period. The developing member comprises: a mandrel; an electro-conductive elastic layer provided on a periphery of the mandrel; and a surface layer provided on a surface of the elastic layer, wherein: the elastic layer contains a dimethyl silicone rubber and carbon black; and an amount $\alpha$ of a hydrogen atom bound to a silicon atom of the dimethyl silicone rubber, and an amount $\beta$ of a hydrogen atom of methyl groups bound to a silicon atom of the dimethyl silicone rubber, satisfy a relationship of $2.5\times10^{-5}\leq\alpha/\beta\leq1.0\times10^{-4}$.

6 Claims, 2 Drawing Sheets

DEVELOPING MEMBER, PROCESS CARTRIDGE, AND ELECTROPHOTOGRAPHIC IMAGE FORMING APPARATUS

CROSS-REFERENCE TO RELATED APPLICATIONS

This application is a continuation of International Application No. PCT/JP2012/006632, filed Oct. 17, 2012, which is claims the benefit of Japanese Patent Application No. 2012-033078, filed Feb. 17, 2012 and Japanese Patent Application No. 2012-227219, filed Oct. 12, 2012.

BACKGROUND OF THE INVENTION

1. Field of the Invention

The present invention relates to a developing member to be incorporated into an apparatus adopting an electrophotographic mode such as a copying machine, a printer, or a receiving equipment of a facsimile, a process cartridge, and an electrophotographic image forming apparatus.

2. Description of the Related Art

A developing member to be used in an electrophotographic apparatus is often provided with an electro-conductive elastic layer containing a silicone rubber in order that stress to be applied to toner may be alleviated and a nip width between the member and an electrophotographic photosensitive member may be secured. In addition, a surface of such elastic layer is often provided with a surface layer for, for example, controlling charging of the toner and controlling a conveyance amount of the toner.

By the way, a recent electrophotographic apparatus has started to be required to have higher image quality and higher durability. Accordingly, its developing member has also started to be required to have higher durability. In some cases, however, a charging member provided with an elastic layer containing a silicone rubber, the layer being made electro-conductive by incorporating an electro-conductive agent such as carbon black, has shown a variation in electrical resistance owing to its long-term use, and the variation has affected the quality of an electrophotographic image.

Meanwhile, Japanese Patent Application Laid-Open No. 2001-158856 discloses a semiconductive silicone rubber composition whose electrical resistance hardly varies owing even to, for example, an environmental change such as a temperature or humidity change, a change in blending amount of carbon black, or application of a high voltage. Specifically, the Japanese Patent Application Laid-Open No. 2001-158856 discloses a semiconductive silicone rubber composition whose electrical resistance hardly varies, the composition being obtained by incorporating, into a silicone rubber, thermal black having a specific nitrogen adsorption specific surface area, a specific DBP oil absorption amount, and a specific average particle diameter obtained by thermally decomposing a natural gas. In addition, the Japanese Patent Application Laid-Open No. 2001-158856 discloses an application of such semiconductive silicone rubber composition to an electro-conductive roller.

SUMMARY OF THE INVENTION

According to an investigation conducted by the inventors of the present invention, however, a developing member provided with an elastic layer formed by using the semiconductive silicone rubber composition according to Japanese Patent Application Laid-Open No. 2001-158856 has sometimes been observed to show a large variation in electrical resistance when exposed to a high-temperature, high-humidity environment, e.g., an environment having a temperature of 40° C. and a humidity of 95% RH for a long time period.

In view of the foregoing, the present invention is directed to providing a developing member obtained by providing an elastic layer formed of a silicone rubber and carbon black on a mandrel and providing a surface layer on the elastic layer, the developing member being capable of suppressing a variation in electrical resistance with higher reliability even when exposed to a high-temperature, high-humidity environment, e.g., an environment having a temperature of 40° C. and a humidity of 95% RH for a long time period.

Further, the present invention is directed to providing a process cartridge and an electrophotographic image forming apparatus capable of stably providing high-quality electrophotographic images under various environments.

According to one aspect of the present invention, there is provided a developing member, comprising: a mandrel; an electro-conductive elastic layer provided on a periphery of the mandrel; and a surface layer provided on a surface of the elastic layer, wherein: the elastic layer contains a dimethyl silicone rubber and carbon black; and an amount $\alpha$ of a hydrogen atom bound to a silicon atom of the dimethyl silicone rubber, and an amount $\beta$ of a hydrogen atom of methyl group bound to a silicon atom of the dimethyl silicone rubber, satisfy a relationship of $2.5\times10^{-5}\leq\alpha/\beta\leq1.0\times10^{-4}$.

According to another aspect of the present invention, there is provided a process cartridge, comprising the above-described developing member, wherein the process cartridge is detachably mountable to a main body of an electrophotographic image forming apparatus.

According to further aspect of the present invention, there is provided an electrophotographic image forming apparatus, comprising: an image-bearing member for bearing an electrostatic latent image; a charging unit for primarily charging the image-bearing member; an exposing unit for forming an electrostatic latent image on the primarily charged image-bearing member; a developing unit for developing the electrostatic latent image with toner to form a toner image; and a transferring unit for transferring the toner image onto a transfer material, wherein the developing unit comprises the above-described developing member.

According to the present invention, there is provided the developing roller that shows only a small variation in electrical resistance even when exposed to a high-temperature, high-humidity environment, e.g., an environment having a temperature of 40° C. and a humidity of 95% RH for a long time period, and hence provides a high-quality image. Further, according to the present invention, provided are the process cartridge and the electrophotographic image forming apparatus capable of stably providing high-quality electrophotographic images even under various environments.

Further features of the present invention will become apparent from the following description of exemplary embodiments with reference to the attached drawings.

DESCRIPTION OF THE EMBODIMENTS

Figure 1:
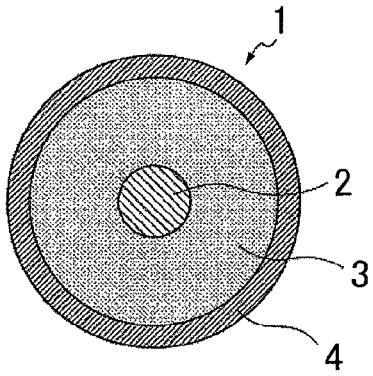
FIG. 1 is a conceptual view illustrating an example of a developing roller of the present invention.

The inventors of the present invention have investigated a cause for a large variation in electrical resistance of a developing member having an electro-conductive elastic layer formed by using the semiconductive silicone rubber composition according to Japanese Patent Application Laid-Open No. 2001-158856 when the member is exposed to a high-temperature, high-humidity environment, e.g., an environment having a temperature of 40° C. and a humidity of 95% RH for a long time period. As a result, the inventors of the present invention have found that the variation results from the moisture absorption of a dimethyl silicone rubber in the elastic layer. In view of the foregoing, the inventors of the present invention have investigated the suppression of the moisture absorption of the dimethyl silicone rubber of the elastic layer through a reduction in moisture permeability of a surface layer covering the elastic layer. However, it has been difficult to produce a surface layer having such low moisture permeability that the variation in electrical resistance due to the moisture absorption of the dimethyl silicone rubber can be suppressed with reliability.

Further, the inventors have investigated, for example, the kind and amount of carbon black to be blended into the dimethyl silicone rubber. However, the inventors have been unable to find such a construction that the variation in electrical resistance when the member is exposed to a high-temperature, high-humidity environment, e.g., an environment having a temperature of 40° C. and a humidity of 95% RH for a long time period is significantly suppressed.

In the course of the investigation of the moisture absorption of the dimethyl silicone rubber, however, the inventors of the present invention have found that a hydrogen atom bound to a silicon atom present in the dimethyl silicone rubber (hereinafter, sometimes referred to as "Si—H group") correlates with the moisture absorption of the silicone rubber.

Specifically, the inventors have found that setting the amount of Si—H groups in the dimethyl silicone rubber of the elastic layer within a specific range can reduce the amount of moisture in the elastic layer containing the dimethyl silicone rubber to an extremely low level.

Although the mechanism via which the amount of the Si—H groups and the moisture absorption of the dimethyl silicone rubber correlate with each other has not been elucidated, the following assumption has been made. Incorporating a predetermined amount of the Si—H groups into the dimethyl silicone rubber causes an Si—H group of the dimethyl silicone rubber to preferentially orient inward (toward the elastic layer) at an interface between the elastic layer and the surface layer. As a result, a methyl group bound to a silicon atom of the dimethyl silicone rubber orients outward (toward the surface layer) to form a hydrophobic surface, and the hydrophobic surface inhibits the adsorption of moisture to the surface of the elastic layer and inhibits the permeation of moisture into the elastic layer.

Hereinafter, the present invention is described in detail. FIG. 1 illustrates a conceptual view of a developing roller according to the present invention. A developing roller 1 in the figure has an elastic layer 3 on the outer periphery of a mandrel 2 and has a surface layer 4 on the outer periphery of the elastic layer 3.

(Mandrel)

The mandrel is not particularly limited and a hollow or solid mandrel can be used. In addition, the mandrel has only to function as an electrode and supporting member for the developing roller, and is constituted of an electro-conductive material such as: a metal or an alloy like aluminum, copper alloy, or stainless steel; iron subjected to a plating treatment with chromium or nickel; or a synthetic resin having electro-conductivity. Further, the mandrel 2 made of metal may be subjected to a rust preventive treatment such as an oxidation treatment or to a primer treatment at the correct time.

(Elastic Layer)

In the present invention, it is essential that: the elastic layer provided on the periphery of the mandrel contains a dimethyl silicone rubber and carbon black; and the amount $\alpha$ of hydrogen atoms bound to silicon atoms of the dimethyl silicone rubber (hereinafter, also referred to as "Si—H groups") and the amount $\beta$ of hydrogen atoms of methyl groups bound to silicon atoms of the dimethyl silicone rubber (hereinafter, also referred to as "Si—$CH_3$ groups") satisfy a relationship of $2.5\times10^{-5}\leq\alpha/\beta\leq1.0\times10^{-4}$.

Even a liquid silicone rubber or a millable silicone rubber can be used as the dimethyl silicone rubber of the elastic layer without any particular limitation as long as any such rubber has an Si—H group. Of those, a liquid silicone rubber utilizing a hydrosilylation reaction is preferred because the amount of the Si—H groups remaining in the dimethyl silicone rubber is easily controlled depending on the blending of its raw materials and conditions for its production.

In the hydrosilylation reaction, (A) a liquid dimethylpolysiloxane having, in a molecule thereof, two or more alkenyl groups bound to a silicon atom, (B) a platinum-based catalyst, and (C) a dimethylpolysiloxane having, in a molecule thereof, two or more hydrogen atoms bound to a silicon atom are subjected to a crosslinking reaction.

The liquid dimethylpolysiloxane having, in a molecule thereof, two or more alkenyl groups bound to a silicon atom as the component (A) is a main component for crosslinking to serve as a rubber. The following can be given as examples of the component (A): a dimethylpolysiloxane having both molecular terminals capped with dimethylvinylsiloxy groups, a dimethylsiloxane-methylvinylsiloxane copolymer having both molecular terminals capped with dimethylvinylsiloxy groups, a dimethylsiloxane-methylvinylsiloxane copolymer having both molecular terminals capped with trimethylsiloxy groups, and a mixture of two or more kinds thereof. The molecular structure thereof is preferably a linear structure, and may be a linear structure having a partially branched molecular chain.

In addition, the component (A) is preferably liquid and its viscosity at 25° C. falls within the range of preferably 100 to 10,000,000 mPa·s, particularly preferably 1,000 to 2,000,000 mPa·s. A viscosity deviating from the range may reduce handleability or may cause a burr upon performance of molding with a mold.

The following can be given as examples of the platinum-based catalyst as the component (B): a platinum fine powder, platinum black, chloroplatinic acid, an alcohol-modified chloroplatinic acid, an olefin complex of chloroplatinic acid, a complex of chloroplatinic acid and an alkenylsiloxane, and a thermoplastic resin powder containing any such platinum-based catalyst. The amount of the platinum-based catalyst is preferably 0.1 to 500 ppm in terms of a platinum metal with respect to the dimethylpolysiloxane as the component (A).

The dimethylpolysiloxane having, in a molecule thereof, two or more hydrogen atoms bound to a silicon atom as the component (C) is crosslinked with the alkenyl groups of the component (A) by a hydrosilylation reaction through the action of the platinum-based catalyst as the component (B). The following can be given as examples of the component (C): a polymethylhydrogensiloxane having both molecular terminals capped with trimethylsiloxy groups, a dimethylsiloxane-methylhydrogensiloxane copolymer having both molecular terminals capped with trimethylsiloxy groups, a dimethylsiloxane-methylhydrogensiloxane copolymer having both molecular terminals capped with dimethylhydrogensiloxy groups, a cyclic dimethylsiloxane-methylhydrogensiloxane copolymer, a cyclic polymethylhydrogensiloxane, a polydimethylsiloxane having both molecular terminals capped with dimethylhydrogensiloxy groups, and a mixture of two or more kinds of those dimethylpolysiloxanes.

In addition, the viscosity of the component (C) at 25° C., which is not particularly limited, preferably falls within the range of 2 to 100,000 mPa·s. In the present invention, the amount of the component (C) is preferably adjusted as follows because the elastic layer 3 requires a desired amount of remaining Si—H groups: the total number of moles of the hydrogen atoms bound to the silicon atoms of the component (C)/the total number of moles of the alkenyl groups of the component (A)=1/1 to 10/1.

A ratio ($\alpha/\beta$) of the amount $\alpha$ of the Si—H groups to the amount $\beta$ of the Si—$CH_3$ groups in the dimethyl silicone rubber in the elastic layer needs to have a relationship of $2.5\times10^{-5}\leq\alpha/\beta\leq1.0\times10^{-4}$ in order that a variation in electrical resistance of a charging member due to the moisture absorption of the elastic layer may be significantly suppressed.

In addition, the ratio $\alpha/\beta$ preferably falls within the range of $3.0\times10^{-5}\leq\alpha/\beta\leq6.0\times10^{-5}$ because an effect of the present invention can be additionally expressed.

When the value for the ratio $\alpha/\beta$ is smaller than $2.5\times10^{-5}$, the amount of the Si—H groups in the silicone rubber is so small that the moisture absorption of the silicone rubber cannot be effectively prevented and hence a variation in resistance of the developing roller 1 occurs in some cases. In addition, when the value for the ratio $\alpha/\beta$ is larger than $1.0\times10^{-4}$, the moisture absorption of the silicone rubber can be prevented but the amount of the Si—H groups in the silicone rubber is large. Accordingly, a side reaction progresses to change a crosslinking form, with the result that the variation in resistance occurs in some cases.

The amount $\alpha$ of the Si—H groups and the amount $\beta$ of the Si—$CH_3$ groups of the elastic layer are determined by subjecting the elastic layer to solid-state $^1$H-NMR measurement. In the resultant solid-state $^1$H-NMR spectrum, the area of a proton peak around 4.8 ppm assigned to a hydrogen atom bound to a silicon atom is represented by $\alpha$ and the area of a proton peak around 0.1 ppm assigned to a hydrogen atom of a methyl group bound to a silicon atom is represented by $\beta$. The ratio $\alpha/\beta$ is determined by dividing the resultant value for the $\alpha$ by the value for the $\beta$. A specific measurement method is described below.

(Measurement Method)

A measurement sample was prepared by cutting the elastic layer with a knife or the like, followed by freezing and crushing. The measurement sample was subjected to the solid-state $^1$H-NMR measurement by a single pulse method (background subtraction method). The measurement conditions are as described below.

Apparatus: AVANCE 400 manufactured by Bruker
Frequency of observed nucleus: 400 MHz ($^1$H nucleus)
Spectrum width: 40 kHz
Pulse width: 1.1 μsec. (30° pulse)
Pulse repetition time: ACQTM: 0.2048625 sec, PD: 5.0 sec
Number of scans: 3,000 times
Acquisition points: 16,384 (data points: 65,536)
Reference substance: polydimethylsiloxane (external reference: 0.119 ppm)
Temperature: 22° C.
Sample spinning rate: 10 kHz In the dimethyl silicone rubber in the elastic layer, carbon black is dispersed, and the electric resistance thereof is adjusted to fall within an appropriate range. Specific examples of the carbon black which may be used include acetylene black, conductive furnace black (CF), super conductive furnace black (SCF), extra conductive furnace black (XCF), conductive channel black (CC), and furnace black and channel black each subjected to a heat treatment at a high temperature of about 1,500° C.

The carbon black is typically used in an amount in the range of 1.0 part by mass or more and 30 parts by mass or less with respect to 100 parts by mass of the dimethylpolysiloxane as the component (A). An amount deviating from the range makes it difficult to obtain a stable volume resistivity and deteriorates the flowability of the material in some cases.

Various additives such as a plasticizer, a filler, an extender, a vulcanizing agent, a vulcanization aid, a crosslinking aid, a curing inhibitor, an antioxidant, an age resistor, and a processing aid, and silica, a quartz powder, and calcium carbonate can each be incorporated into the elastic layer as required. Any such arbitrary component is blended in an amount in such a range that the function of the elastic layer 3 is not inhibited.

As a guideline, the hardness of the elastic layer is preferably 20° or more and 80° or less in terms of Asker C hardness. As a guideline, the thickness of the elastic layer is preferably 0.5 mm or more and 6.0 mm or less.

As a mixing machine for various materials for forming the elastic layer, there are given, for example: a dynamic mixing machine such as a uniaxial continuous kneader, a biaxial continuous kneader, a twin roll, a kneader mixer, or TRIMIX; and a static mixing machine such as a static mixer.

A die molding method, an extrusion molding method, an injection molding method, and an application molding method can be given as examples of a method of forming the elastic layer on the mandrel. More specifically, the following methods are given: a method involving extruding the mandrel 2 and a material for the elastic layer 3 of the present invention to mold the layer, and when the material is liquid, a method involving injecting the material into a mold, which is obtained by placing a cylindrical pipe and a die for holding the mandrel 2 placed at each of both terminals of the pipe, and heating the material to cure the material.

The surface of the elastic layer can also be modified by a surface modification process such as surface polishing, a corona treatment, a flame treatment, or an excimer treatment from the viewpoint of an improvement in adhesiveness with the surface layer.

(Surface Layer)

The surface layer is provided on the surface of the elastic layer to protect the elastic layer, impart appropriate charge to toner, and impart satisfactory conveyability of toner to the elastic layer. The following can be given as examples of a material for the surface layer: thermoplastic resins such as a styrene-based resin, a vinyl-based resin, a polyether sulfone resin, a polycarbonate resin, a polyphenylene oxide resin, a polyamide resin, a fluororesin, a cellulose-based resin, and an acrylic resin; and an epoxy resin, a polyester resin, an alkyd resin, a phenol resin, a melamine resin, a benzoguanamine resin, a polyurethane resin, a urea resin, a silicone resin, a polyimide resin, and a photo-curable resin. Of those, a urethane resin is particularly preferred because of its excellent triboelectric charge-imparting performance to toner.

The resistance of the surface layer is adjusted to fall within an appropriate range by blending a conductivity-imparting agent such as an electro-conductive substance or an ionic-conductive substance into the material. The following can be given as examples of the electro-conductive substance to be used for imparting conductivity to the surface layer: electro-conductive carbon blacks such as Ketjen black EC and acetylene black; carbon blacks for rubber such as SAF, ISAF, HAF, FEF, GPF, SRF, FT, and MT; carbon blacks for color (ink) each subjected to an oxidation treatment; and a metal such as copper, silver, or germanium and an oxide thereof. Of those, carbon black is preferred because it is easy to control conductivity with a small amount of carbon black. In addition, the following can be given as examples of the ionic-conductive substance to be used for imparting conductivity to the surface layer 4: inorganic ionic-conductive substances such as sodium perchlorate, lithium perchlorate, calcium perchlorate, and lithium chloride; and organic ionic-conductive substances such as a modified aliphatic dimethylammonium ethosulfate and stearylammonium acetate.

Any such conductivity-imparting agent is typically used in an amount in the range of 1 part by mass or more and 50 parts by mass or less with respect to 100 parts by mass of the material.

The surface layer may also contain a crosslinking agent, a plasticizer, a filler, an extender, a vulcanizing agent, a vulcanization aid, a crosslinking aid, an antioxidant, an age resistor, a processing aid, and a leveling agent to such an extent that the function thereof is not impaired. In addition, when the surface layer needs to have surface roughness, fine particles for imparting the surface roughness of the surface layer 4 may be added to the surface layer 4. Specifically, fine particles of a polyurethane resin, a polyester resin, a polyether resin, a polyamide resin, an acrylic resin, and a polycarbonate resin may be used.

Although a method of forming the surface layer is not particularly limited, the layer can be formed by, for example, dispersing and mixing the respective components of the surface layer in a solvent to prepare a paint, applying the paint onto the elastic layer, and drying the applied paint to solidify the paint or heating the applied paint to cure the paint. A known dispersing apparatus utilizing beads such as a sand mill, a paint shaker, a Dyno-mill, or a pearl mill can be utilized in the dispersion and mixing. Application methods which may be utilized include a dip coating method, a ring coating method, a spray coating method, or a roll coating method. The thickness of the surface layer was adjusted to 1 μm or more and 100 μm or less at the correct time.

(Process Cartridge and Electrophotographic Image Forming Apparatus)

Figure 2:
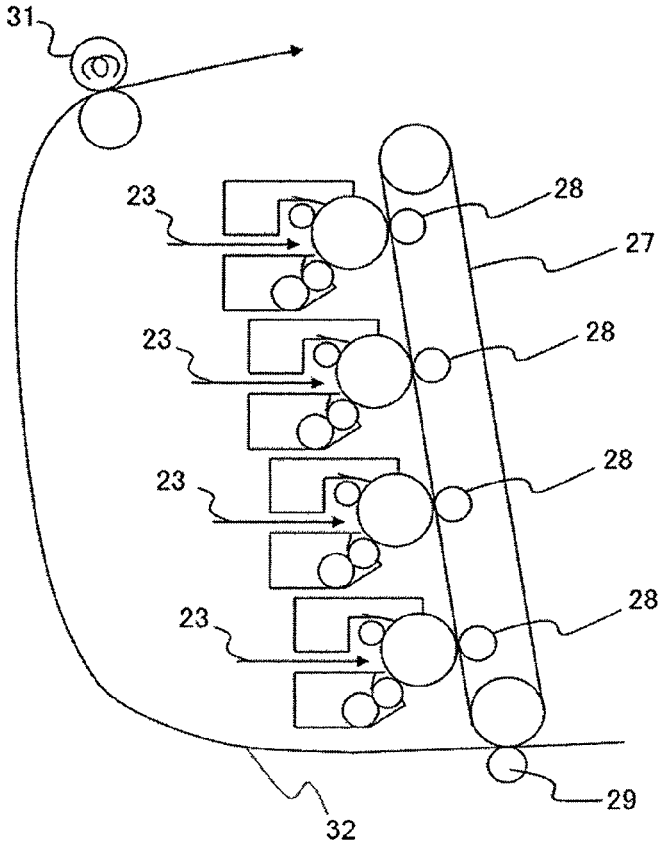
FIG. 2 is a schematic construction view illustrating an example of an electrophotographic image forming apparatus of the present invention.
Figure 3:
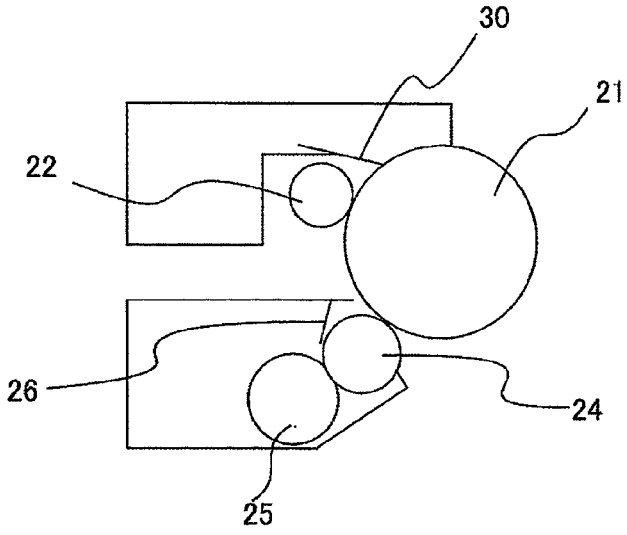
FIG. 3 is a schematic construction view illustrating an example of a process cartridge of the present invention.

FIG. 2 is a sectional view illustrating the outline of an electrophotographic image forming apparatus of the present invention. FIG. 3 is an enlarged sectional view of a process cartridge to be mounted on the electrophotographic image forming apparatus of FIG. 2. The process cartridge includes: an image-bearing member 21 for bearing an electrostatic latent image such as a photosensitive drum; a charging unit for primarily charging the image-bearing member, the charging unit having a charging member 22; a developing unit for developing the electrostatic latent image with toner to form a toner image, the developing unit having a developing roller 24; and a cleaning unit having a cleaning member 30. In addition, the process cartridge is detachably mountable to the main body of the electrophotographic image forming apparatus of FIG. 2.

The image-bearing member 21 is uniformly charged (primarily charged) by the charging member 22 connected to a bias power source (not shown). The charged potential of the image-bearing member 21 at this time is −800 V or more and −400 V or less. Next, the image-bearing member 21 is irradiated with exposure light 23 for writing the electrostatic latent image from an exposing unit (not shown) for forming the electrostatic latent image on the primarily charged image-bearing member, whereby the electrostatic latent image is formed on the surface of the image-bearing member 21. LED light and laser light can each be used as the exposure light 23. The surface potential of the image-bearing member 21 in the exposed portion is −200 V or more and −100 V or less.

Next, the toner charged to negative polarity by the developing roller 24 is applied to (used in the development of) the electrostatic latent image. Thus, the toner image is formed on the image-bearing member 21 and the electrostatic latent image is transformed into a visible image. At this time, a voltage of −500 V or more and −300 V or less is applied to the developing roller 24 by a bias power source (not shown). It should be noted that the developing roller 24 is in contact with the image-bearing member 21 with a nip width of 0.5 mm or more and 3 mm or less therebetween. In the process cartridge of the present invention, a toner-supplying roller 25 is brought in a rotatable state into abutment with the developing roller 24 on the upstream side of the rotation of the developing roller 24 with respect to the abutting portion of a developing blade 26 as a toner control member and the developing roller 24.

The toner image developed on the image-bearing member 21 is primarily transferred onto an intermediate transfer belt 27. A primary transferring member 28 abuts on the back surface of the intermediate transfer belt 27, and the application of a voltage of +100 V or more and +1,500 V or less to the primary transferring member 28 results in the primary transfer of the toner image with negative polarity from the image-bearing member 21 onto the intermediate transfer belt 27. The primary transferring member 28 may be of a roller shape, or may be of a blade shape.

When the electrophotographic image forming apparatus is a full-color image forming apparatus, the respective steps of the charging, exposure, development, and primary transfer need to be performed for each of a yellow color, a cyan color, a magenta color, and a black color. To this end, the electrophotographic image forming apparatus illustrated in FIG. 2 mounts one process cartridge including the toner corresponding to any one of the colors, i.e., a total of four process cartridges in a state where the process cartridges are detachably mountable to the main body of the electrophotographic image forming apparatus. In addition, the respective steps of the charging, exposure, development, and primary transfer are sequentially performed with a predetermined time difference. Thus, a state where toner images corresponding to the four colors for representing a full-color image are superimposed on one another is established on the intermediate transfer belt 27.

The toner images on the intermediate transfer belt 27 are conveyed to a position opposite to a secondary transferring member 29 in association with the rotation of the intermediate transfer belt 27. Recording paper as a transfer material is conveyed into a gap between the intermediate transfer belt 27 and the secondary transferring member 29 along a conveying route 32 for the recording paper at a predetermined timing, and the application of a secondary transfer bias to the secondary transferring member 29 results in the transfer of the toner images on the intermediate transfer belt 27 onto the recording paper. At this time, the bias voltage to be applied to the secondary transferring member 29 is +1,000 V or more and +4,000 V or less. The recording paper onto which the toner images have been transferred by the secondary transferring member 29 is conveyed to a fixing unit 31 where the toner images on the recording paper are melted to be fixed onto the recording paper. After that, the recording paper is discharged to the outside of the electrophotographic image forming apparatus. Thus, a print operation is completed.

It should be noted that the toner remaining on the image-bearing member 21 without being transferred from the image-bearing member 21 onto the intermediate transfer belt 27 is scraped off by the cleaning member 30 for cleaning the surface of the image-bearing member 21. Thus, the surface of the image-bearing member 21 is cleaned.

EXAMPLES

Hereinafter, the present invention is described in more detail by way of specific examples. However, the examples should not be construed as limitations on the technical scope of the present invention.

Example 1

<Preparation of Mandrel>

A mandrel was obtained by: applying a primer (trade name: DY35-051; manufactured by Dow Corning Toray Co., Ltd.) onto a cored bar made of SUS304 having an outer diameter of 6 mm and a length of 264 mm; and baking the primer at a temperature of 150° C. for 20 minutes.

<Production of Elastic Roller>

The mandrel was placed in a cylindrical mold having an inner diameter of 11.5 mm so as to be concentric with the mold. An addition type silicone rubber composition was prepared by mixing materials shown in Table 1 below with TRI-MIX and injected into the mold heated to a temperature of 115° C. After the injection of the materials, the composition was heated and molded at a temperature of 120° C. for 5 minutes, cooled to room temperature, and then taken out of the mold. Thus, an elastic roller No. 1 was obtained.

TABLE 1

| Material | Blending amount (part(s) by mass) |
|---|---|
| Liquid dimethylpolysiloxane having, in a molecule thereof, two or more alkenyl groups bound to a silicon atom (trade name: SF3000E, viscosity: 10,000 cP, vinyl group equivalent: 0.05 mmol/g, manufactured by KCC) | 100 |
| Platinum-based catalyst (trade name: SIP6832.2, manufactured by Gelest, Inc.) | 0.048 |
| Dimethylpolysiloxane having, in a molecule thereof, two or more hydrogen atoms bound to a silicon atom (trade name: SP6000P, Si—H group equivalent: 15.5 mmol/g, manufactured by KCC) | 0.5 |
| Carbon black (trade name: TOKABLACK #7360SB, manufactured by TOKAI CARBON CO., LTD.) | 6.0 |

<Production of Surface Layer>

Next, materials shown in Table 2 below as materials for a surface layer were mixed. After that, methyl ethyl ketone (manufactured by Aldrich) was added to the mixture so that the total solid content ratio was 30 mass %, and then the contents were uniformly dispersed with a sand mill.

TABLE 2

| Material | Blending amount (part(s) by mass) |
|---|---|
| Polyester polyol (trade name: Nippolan 3027, manufactured by Nippon Polyurethane Industry Co., Ltd.) | 100 |
| Isocyanate (trade name: CORONATE 2233, manufactured by Nippon Polyurethane Industry Co., Ltd.) | 120 |
| Carbon black (trade name: MA230, manufactured by Mitsubishi Chemical Corporation) | 33.7 |

Methyl ethyl ketone was added to the resultant dispersion to adjust its solid content to 25 mass %. Next, 15 parts by mass of polyurethane resin particles (trade name: ARTPERL C400, manufactured by Negami Chemical Industrial Co., Ltd.) were added to the mixture, and then the contents were stirred and dispersed with a ball mill. Thus, a paint No. 1 for forming a surface layer was obtained.

The elastic roller No. 1 was immersed in the paint No. 1 for forming a surface layer. Thus, a coating film of the paint No. 1 for forming a surface layer was formed on the surface of the elastic layer. The thickness of the coating film was 15 μm. After that, the coating film was calcined at a temperature of 130° C. for 60 minutes. Thus, a developing roller No. 1 was produced.

Examples 2 to 4

Elastic rollers Nos. 2 to 4 were each produced in the same manner as in the elastic roller No. 1 except that in the production of the elastic roller No. 1, the heating temperature and heating time upon formation of the elastic layer after the injection of the materials for forming the elastic layer into the mold were changed as shown in Table 3 below. In addition, developing rollers Nos. 2 to 4 were each produced in the same manner as in Example 1 except that: any one of the elastic rollers Nos. 2 to 4 was used; and the temperature and calcination time upon formation of the surface layer through the calcination of the coating film of the paint No. 1 for forming a surface layer were changed as shown in Table 3 below.

TABLE 3

| | At the time of the formation of the elastic layer | | At the time of the formation of the surface layer | |
|---|---|---|---|---|
| Example | Heating temperature (° C.) | Heating time (min.) | Calcination temperature (° C.) | Calcination time (min.) |
| 2 | 120 | 3 | 140 | 60 |
| 3 | 120 | 3 | 130 | 60 |
| 4 | 120 | 3 | 130 | 30 |

Examples 5 and 6

Elastic rollers Nos. 5 and 6 were each produced in the same manner as in the elastic roller No. 1 except that in the production of the elastic roller No. 1, the blending amount of the dimethylpolysiloxane having, in a molecule thereof, two or more hydrogen atoms bound to a silicon atom (trade name: SP6000P, Si—H group equivalent: 15.5 mmol/g, manufactured by KCC) in Table 1, and the heating temperature and heating time after the injection of the materials for forming the elastic layer into the mold were changed as shown in Table 4 below. In addition, developing rollers Nos. 5 and 6 were each produced in the same manner as in Example 1 except that: any one of the elastic rollers Nos. 5 and 6 was used; and the calcination temperature and calcination time for the coating film of the paint No. 1 for forming a surface layer were changed as shown in Table 4 below.

TABLE 4

| Example | Blending amount of the dimethylpolysiloxane having, in a molecule thereof, two or more hydrogen atoms bound to a silicon atom (part(s) by mass) | At the time of the formation of the elastic layer | | At the time of the formation of the surface layer | |
|---|---|---|---|---|---|
| | | Heating temperature (° C.) | Heating time (min.) | Calcination temperature (° C.) | Calcination time (min.) |
| 5 | 1.0 | 120 | 3 | 130 | 30 |
| 6 | 2.0 | 120 | 3 | 130 | 30 |

Comparative Examples 1 and 2

The elastic layer of the elastic roller No. 1 was secondarily cured by heating the elastic layer at a temperature shown in Table 5 below for a time period shown in the table. Thus, elastic rollers Nos. C-1 and C-2 were obtained. Developing rollers Nos. C-1 and C-2 according to Comparative Examples 1 and 2 were obtained in the same manner as in Example 1 except that the elastic rollers Nos. C-1 and C-2 were used.

TABLE 5

| Comparative Example | Heating temperature (° C.) | Heating time (min.) |
|---|---|---|
| 1 | 200 | 120 |
| 2 | 200 | 60 |

Comparative Example 3

The elastic layer of the elastic roller No. 5 was secondarily cured by heating the elastic layer at a temperature of 200° C. for 120 minutes. Thus, an elastic roller No. C-3 was obtained. A developing roller No. C-3 according to Comparative Example 3 was obtained in the same manner as in Example 5 except that the elastic roller No. C-3 was used.

Comparative Example 4

An elastic roller No. C-4 was produced in the same manner as in the elastic roller No. 1 except that in the production of the elastic roller No. 1, the blending amount of the dimethylpolysiloxane having, in a molecule thereof, two or more hydrogen atoms bound to a silicon atom (trade name: SP6000P, Si—H group equivalent: 15.5 mmol/g, manufactured by KCC) in Table 1 was changed to 3.0 parts by mass, and the heating temperature and heating time after the injection of the materials for forming the elastic layer into the mold were changed to 120° C. and 3 minutes, respectively. A developing roller No. C-4 was produced in the same manner as in Example 1 except that: the elastic roller No. C-4 was used; and the calcination temperature and calcination time for the coating film of the paint No. 1 for forming a surface layer were changed to 130° C. and 30 minutes, respectively.

Comparative Example 5

A developing roller No. C-5 was produced in the same manner as in Example 1 except that in the production of the elastic roller No. 1, the heating temperature and heating time after the injection of the materials for forming the elastic layer into the mold were changed to 160° C. and 45 minutes, respectively.

Comparative Example 6

In order for an elastic layer to be produced, materials shown in Table 6 below were kneaded with an open roll to be sufficiently mixed and dispersed.

TABLE 6

| Material | Blending amount (part(s) by mass) |
|---|---|
| Silicone raw rubber (trade name: TSE260-3U, manufactured by GE Toshiba Silicone) | 50 |
| (Silicone raw rubber (trade name: TSE260-5U, manufactured by GE Toshiba Silicone) | 50 |
| Organic peroxide crosslinking agent (trade name: TC-4, manufactured by GE Toshiba Silicone) | 3 |
| Carbon black (trade name: N991, manufactured by Cancarb) | 65 |

The resultant semiconductive composition and a mandrel obtained in the same manner as in Example 1 were extruded to provide a molded body having an outer diameter of 13.0 mm. After that, the molded body was primarily vulcanized at a temperature of 170° C. for 15 minutes. After that, the resultant was secondarily heated at 200° C. for 120 minutes, followed by polishing. Thus, an elastic roller No. C-6 having an outer diameter of 11.5 mm having an elastic layer was obtained.

A developing roller No. C-6 was obtained in the same manner as in Example 1 except that the elastic roller No. 1 was changed to the elastic roller No. C-6.

(Evaluation 1; calculation of $\alpha/\beta$)

The elastic layer was cut out of each of the developing rollers Nos. 1 to 6 according to Examples 1 to 6 and the developing rollers Nos. C-1 to C-6 according to Comparative Examples 1 to 6 with a knife, and then the $\alpha$ as the amount of Si—H groups and the $\beta$ as the amount of Si—$CH_3$ groups remaining in the elastic layer were determined by solid-state $^1$H-NMR measurement described in the foregoing. Tables 9 and 10 below show the results.

(Evaluation 2; Electrical Resistance Stability Evaluation)

Each of the developing rollers Nos. 1 to 6 according to Examples 1 to 6 and the developing rollers Nos. C-1 to C-6 according to Comparative Examples 1 to 6 was left to stand under an environment having a temperature of 23° C. and a humidity of 55% RH for 24 hours, and then the electrical resistance value (initial) of the developing roller was determined by the following measurement method.

Figure 4:
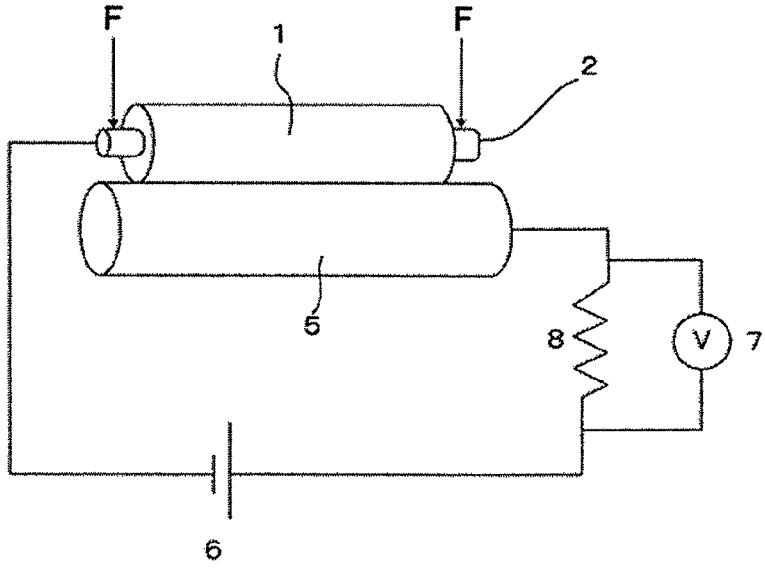
FIG. 4 is a schematic construction view of a machine for measuring the electrical resistance of a developing roller.

FIG. 4 illustrates a schematic view of a machine for measuring the electrical resistance of a developing roller. A load F of 4.9 N was applied to each of both end portions of the mandrel 2 of the developing roller 1 to press the developing roller 1 against a metal drum 5 having an outer diameter of 30 mm. While the developing roller 1 was dependently rotated at the number of roller revolutions of 1 rps by the metal drum 5, a voltage of 50 V was applied from a power source 6 to the developing roller 1. Voltage values applied to an internal resistance 8 (1 kΩ) shown in a voltmeter 7 at this time were recorded 3,000 time points for 30 seconds and then the arithmetic average of the voltages was determined. The electrical resistance value (initial) of the developing roller 1 was determined from the resultant value according to Ohm's law.

Next, the developing roller was left to stand under an environment having a temperature of 40° C. and a humidity of 95% RH for 30 days. After that, the developing roller was left to stand under an environment having a temperature of 23° C. and a humidity of 55% RH for 24 hours, and then the electrical resistance value (after standing) of the developing roller was measured in the same manner as in the foregoing. The electrical resistance value (after standing) of the developing roller was divided by its electrical resistance value (initial), and then its electrical resistance stability was judged by criteria shown in Table 7. Table 9 shows the result of the evaluation.

TABLE 7

| Rank | Evaluation criterion |
|---|---|
| A | The value obtained by dividing the electrical resistance value (after standing) by the electrical resistance value (initial) is 0.95 or more and 1.05 or less. |
| B | The value obtained by dividing the electrical resistance value (after standing) by the electrical resistance value (initial) is 0.85 or more and less than 0.95, or is more than 1.05 and 1.15 or less. |
| C | The value obtained by dividing the electrical resistance value (after standing) by the electrical resistance value (initial) is less than 0.85 or is more than 1.15. |

(Evaluation 3: Image Stability Evaluation)

Each of the developing rollers Nos. 1 to 6 according to Examples 1 to 6 and the developing rollers Nos. C-1 to C-6 according to Comparative Examples 1 to 6 was left to stand under an environment having a temperature of 40° C. and a humidity of 95% RH for 30 days. After that, the developing roller was mounted on a process cartridge for a color laser printer (trade name: LBP5050, manufactured by Canon Inc.) and then the process cartridge was mounted on the color laser printer to output an electrophotographic image. A cyan toner mounted on the process cartridge for cyan of the color laser printer was used as toner without being treated.

An evaluation procedure is as described below. One solid image was output under an environment having a temperature of 30° C. and a humidity of 80% RH. A4 size color laser copier paper manufactured by Canon Inc. (basis weight=81.4 g/m$^2$) was used as recording paper. The resultant solid image was subjected to measurement at ten points per image (such ten-point measurement by which a line parallel to a sheet-discharging direction, the line dividing the solid image into two equal sections on left and right sides, was divided into eleven equal sections) with a Macbeth reflection densitometer (manufactured by Macbeth) and an SPI auxiliary filter. A density difference (MAX−MIN) between the maximum density (MAX) and minimum density (MIN) of the resultant image densities at the ten points was calculated, and then an evaluation for image density uniformity was performed according to criteria shown in Table 8 below. Table 10 shows the result of the evaluation.

TABLE 8

| Rank | Evaluation criterion |
|---|---|
| A | The density difference is 0.025 or less. No density unevenness is observed by visual observation. |
| B | The density difference is more than 0.025 and 0.1 or less. Slight density unevenness is observed by visual observation. |
| C | The density difference is more than 0.1. Density unevenness is clearly observed by visual observation. |

TABLE 9

| | α/β | Electrical resistance value (initial) | Electrical resistance value (after standing) | Electrical resistance value (after standing)/ Electrical resistance value (initial) | Electrical resistance stability evaluation rank |
|---|---|---|---|---|---|
| Example 1 | 2.5E−05 | 1.05E+07 | 9.30E+06 | 0.89 | B |
| Example 2 | 3.0E−05 | 1.00E+07 | 9.80E+06 | 0.98 | A |
| Example 3 | 4.2E−05 | 1.08E+07 | 1.09E+07 | 1.01 | A |
| Example 4 | 6.0E−05 | 1.01E+07 | 9.80E+06 | 0.97 | A |
| Example 5 | 8.6E−05 | 1.05E+07 | 1.12E+07 | 1.07 | B |
| Example 6 | 1.0E−04 | 9.10E+06 | 1.05E+07 | 1.15 | B |
| Comparative Example 1 | 1.1E−05 | 5.25E+07 | 1.00E+07 | 0.19 | C |
| Comparative Example 2 | 1.9E−05 | 1.51E+07 | 9.80E+06 | 0.65 | C |
| Comparative Example 3 | 2.1E−05 | 1.09E+07 | 8.50E+06 | 0.78 | C |
| Comparative Example 4 | 1.3E−04 | 1.00E+07 | 2.10E+07 | 2.10 | C |
| Comparative Example 5 | 1.5E−05 | 9.40E+06 | 5.30E+06 | 0.56 | C |
| Comparative Example 6 | 0.0E+00 | 1.20E+10 | 8.80E+09 | 0.73 | C |

TABLE 10

| | α/β | Density difference (MAX-MIN) | Image density uniformity evaluation rank |
|---|---|---|---|
| Example 1 | 2.5E−05 | 0.023 | A |
| Example 2 | 3.0E−05 | 0.015 | A |
| Example 3 | 4.2E−05 | 0.015 | A |
| Example 4 | 6.0E−05 | 0.016 | A |
| Example 5 | 8.6E−05 | 0.024 | A |
| Example 6 | 1.0E−04 | 0.024 | A |
| Comparative Example 1 | 1.1E−05 | 0.028 | B |
| Comparative Example 2 | 1.9E−05 | 0.026 | B |
| Comparative Example 3 | 2.1E−05 | 0.026 | B |

TABLE 10-continued

| | α/β | Density difference (MAX-MIN) | Image density uniformity evaluation rank |
|---|---|---|---|
| Comparative Example 4 | 1.3E−04 | 0.029 | B |
| Comparative Example 5 | 1.5E−05 | 0.027 | B |
| Comparative Example 6 | 0.0E+00 | 0.030 | B |

As can be seen from the results in Tables 9 and 10, each of the developing rollers of Examples 1 to 6 of the present invention can achieve effective suppression of a variation in electrical resistance of the developing roller even when exposed under a high-temperature, high-humidity environment, e.g., an environment having a temperature of 40° C. and a humidity of 95% RH for a long time period. In addition, each of the developing rollers achieves a high level of image density stability after its exposure under a high-temperature, high-humidity environment, e.g., an environment having a temperature of 40° C. and a humidity of 95% RH for a long time period.

This application claims the benefit of Japanese Patent Application No. 2012-033078, filed on Feb. 17, 2012 and Japanese Patent Application No. 2012-227219, filed on Oct. 12, 2012, which are hereby incorporated by reference herein in their entirety.

| Reference Signs List | |
|---|---|
| 1 | developing roller |
| 2 | mandrel |
| 3 | elastic layer |
| 4 | surface layer |
| 5 | metal drum |
| 6 | power source |
| 7 | voltmeter |
| 8 | internal resistance |
| 21 | image-bearing member |
| 22 | charging member |
| 23 | exposure light |
| 24 | developing roller |
| 25 | toner-supplying roller |
| 26 | developing blade |
| 27 | intermediate transfer belt |
| 28 | primary transferring member |
| 29 | secondary transferring member |
| 30 | cleaning member |
| 31 | fixing unit |
| 32 | conveying route for recording paper |

What is claimed is:

1. A developing member, comprising:

a mandrel;

an electro-conductive elastic layer provided on a periphery of the mandrel; and a surface layer provided on a surface of the elastic layer, wherein:

the elastic layer contains a dimethyl silicone rubber and carbon black; and an amount α of a hydrogen atom bound to a silicon atom of the dimethyl silicone rubber, and an amount β of a hydrogen atom of methyl group bound to a silicon atom of the dimethyl silicone rubber, satisfy a relationship of $2.5\times10^{-5}\leq\alpha/\beta\leq1.0\times10^{-4}$.

2. The developing member according to claim 1, wherein the amount α of the hydrogen atom bound to the silicon atom of the dimethyl silicone rubber, and the amount β of the hydrogen atom of the methyl group bound to the silicon atom of the dimethyl silicone rubber, satisfy a relationship of $3.0\times10^{-5}\leq\alpha/\beta\leq6.0\times10^{-5}$.

3. The developing member according to claim 1, wherein the dimethyl silicone rubber is a reaction product of a liquid silicone rubber containing a liquid dimethylpolysiloxane having, in a molecule thereof, two or more alkenyl groups bound to a silicon atom and a dimethylpolysiloxane having, in a molecule thereof, two or more hydrogen atoms bound to a silicon atom.

4. The developing member according to claim 1, wherein the surface layer contains a urethane resin.

5. A process cartridge, comprising the developing member according to claim 1, wherein the process cartridge is detachably mountable to a main body of an electrophotographic image forming apparatus.

6. An electrophotographic image forming apparatus, comprising:

an image-bearing member for bearing an electrostatic latent image;

a charging unit for primarily charging the image-bearing member;

an exposing unit for forming an electrostatic latent image on the primarily charged image-bearing member;

a developing unit for developing the electrostatic latent image with toner to form a toner image; and a transferring unit for transferring the toner image onto a transfer material, wherein the developing unit comprises the developing member according to claim 1.

* * * * *